US006299485B1

(12) United States Patent
Marik

(10) Patent No.: US 6,299,485 B1
(45) Date of Patent: Oct. 9, 2001

(54) ARMOR STOP FOR METAL CLAD CABLE CONNECTOR

(75) Inventor: Gregory C. Marik, Germantown, TN (US)

(73) Assignee: Thomas & Betts International, Sparks, NV (US)

( * ) Notice: Subject to any disclaimer, the term of this patent is extended or adjusted under 35 U.S.C. 154(b) by 0 days.

(21) Appl. No.: 09/274,986

(22) Filed: Mar. 23, 1999

Related U.S. Application Data

(60) Provisional application No. 60/079,744, filed on Mar. 27, 1998.

(51) Int. Cl.[7] ..... H01R 9/03
(52) U.S. Cl. ..... 439/610; 439/98
(58) Field of Search ..... 439/610, 98, 579, 439/584, 583, 580; 174/65 SS

(56) References Cited

U.S. PATENT DOCUMENTS 4,963,104 * 10/1990 Dickie ..... 439/460
5,807,138 * 9/1998 Guiol ..... 439/610
5,951,327 * 9/1999 Marik ..... 439/610
5,962,812 * 10/1999 Miyazaki ..... 174/78

* cited by examiner

*Primary Examiner*—Tulsidas Patel
(74) *Attorney, Agent, or Firm*—Hoffmann & Baron, LLP

(57) ABSTRACT

An armor stop which is removably insertable into a range taking electrical connector defining an elongate cable passageway having opposed first and second openings for terminating first-sized electrical cables of a first range of diameters in abutting engagement therein. The armor stop includes an elongate arcuate armor stop wall having opposed inner and outer surfaces. The inner surface defines a conductor receiving passageway for receiving one or more conductors of a second-sized cable having a diameter smaller than the first-sized cable. The armor stop wall includes a first end insertable into the cable passageway and has a thickness defined between the inner and outer surfaces which prevents the second-sized cables from being inserted into the conductor receiving passageway. The armor stop wall is circumferentially an discontinuous about the cable received in the cable passageway so as to allow the one or more conductors received therein to pass therethrough.

10 Claims, 6 Drawing Sheets

ARMOR STOP FOR METAL CLAD CABLE CONNECTOR

This application claims the benefit of U.S. Provisional Application No. 60/079,744, filed on Mar. 27, 1998.

FIELD OF THE INVENTION

The present invention relates to the field of electrical connectors. More specifically, the present invention is directed to a removable armor stop for a range taking electrical connector for a metal clad cable.

BACKGROUND OF THE INVENTION

Electrical connectors have long been used to terminate and connect a variety of cables which carry electrical power or signals. Electrical cables, such as those carrying power, are supplied in various configurations based upon a particular application or the location in which the cables are to be used. One type of electrical cable includes plural insulated conductors extending within an outer insulated jacket. Such cables may also include an inner metallic sheath or cladding between the outer jacket and the conductors. Connectors of the type used to terminate such cables must provide for field engagement between the outer jacket of the cable and the connector. These connectors must also provide for grounded electrical engagement between the cladding of the cable and the body of the connector.

Connectors of this type may be designed to uniquely terminate one size of electrical cable or to terminate a range of sizes of electrical cables. These connectors typically include intricate components which must be employed to effectively seal the cable and the connector while also adequately establishing ground connection between the cladding of cable and the connector body. Consequently, these connectors must be able to precisely locate the cable within the connector to assure proper ground termination.

It is generally difficult to properly locate cables of different sizes in a single connector. One such connector which may be used to terminate a metal clad electrical cable is shown and described in commonly assigned U.S. Pat. No. 5,059,747 and which is incorporated by reference herein for all purposes. The connector described in the '747 patent provides for field termination of the metal clad electrical cable by effectively establishing a seal between the connector body and the jacket of the cable. This connector also establishes ground connection between the connector body and the metallic jacket of the cable. The connector of the '747 patent provides the ability to accommodate cables of different diameters by providing a grounding element which accommodates metal cladding of different diameters. Thus the connector of the '747 patent provides a range taking feature with respect to the metal cladding of the cable.

Another example of a range taking electrical connector is provided in the commonly U.S. Pat. No. 5,951,327 by reference herein for all purposes. The range taking feature of this connector is enhanced by the provision of a removable armor stop which inserts into one end of the connector body. The armor stop desirably takes the form of an elongate cylindrical wall having a given thickness and is threadingly received within a cable egress end of the connector body. When inserted into the connector, the armor stop provides one transverse edge in substantially coplanar alignment with an annular internal shoulder of the connector. The annular edge of the metal cladding normally abuts against the internal shoulder of the connector when fully inserted therein. The thickness of the insertable armor stop at its transverse edge allows the connector to accommodate an even greater range of diameters of metal cladding of the cable which the connector may then accommodate. The armor stop further provides a positive position stop for ensuring correct positioning of the metal cladding within the connector so as to provide secure mechanical and electrical connection of the cable. The art has also seen other designs for armor stops which increase the range taking ability of a connector such as, for example, a washer type component employed against the internal shoulder and allowing the conductors of the cable to pass through a central aperture that is smaller than that defined by the internal shoulder.

Once the metal clad cable is properly positioned within the connector, the conductors of the cable extend from the cladding adjacent the internal shoulder through an open sealing chamber which defines the exit end of the connector. The armor stops, being about the conductors of the cable, are similarly positioned within this sealing chamber. For some applications in hazardous locations it is desirable to fill the vacant portion of the sealing chamber with a sealing or potting compound so as to seal the connector and prevent the formation of a flame path therethrough.

It is generally desirable to remove the armor stop from the connector so that the sealing compound may more fully flow into, and more fully occupy, the sealing chamber. The circumstances surrounding the installation, however, may complicate removal of the armor stop. For instance, it is common for an installer to insert the free ends of the conductors through a panel or wall prior to potting, rendering the free ends of the conductor inaccessible for the simple sliding of the armor stop thereover. Additionally, many installers prefer to terminate the free ends of the conductors prior to potting the conductors within the connector. Furthermore, the length of an exposed conductor extending from a connector can be quite long so that it is inconvenient for the installer to attempt to slide the armor stop off the free ends thereof.

When using a cylindrical armor stop of the above-mentioned copending application, the installer must therefore cut the armor stop in order to remove it from about the conductors of the cable. Cutting through the armor stop poses a risk of the installer also cutting through an inner insulation covering or an internal conductor of the cable and adversely affecting the performance of the cable. Additionally, in order to remove a washer type armor stop of the prior art, it is necessary to disassemble the connector after the cable has been fixed with respect to one component of the connector. The disassembly operation can be time consuming and, in some workspaces or environmental conditions, difficult to perform. Such disassembly operations also present a risk of the connector being improperly re-assembled.

SUMMARY OF THE INVENTION

The present invention provides a removable armor stop for a range taking electrical connector for a metal clad cable which provides a positive stop for cable being inserted into the connector so as to ensure correct and secure mechanical and electrical connection between the cable and the connector.

The present invention further provides a removable armor stop for a range taking electrical connector which may be manually removed by an installer without requiring additional tools.

The present invention still further provides a removable armor stop for a range taking electrical connector which reliably seats various sizes of metal clad cable within the electrical connector and which is removably insertably engagable with the electrical connector and removably receivable of the conductors of the metal clad cable through an elongate opening formed therein.

The armor stop of the present invention is removably insertable into a range taking electrical connector used for terminating a first-sized multiconductor cable having a metal cladding of a diameter within a first range of diameters. The connector includes a connector housing defining a cable ingress opening, a conductor egress opening, and an elongate cable passageway extending therebetween. The connector further includes an internal annular shoulder extending into the cable passageway and providing for abutting engagement with the metal cladding of a first-sized cable. The removable armor stop is insertable into the conductor egress opening for providing abutting engagement with metal cladding of a second-sized multiconductor cable having a diameter smaller than the first-sized cable. The removable armor stop includes an elongate arcuate armor stop wall having opposed inner and outer surfaces. The inner surface defines a conductor receiving passageway for receiving one or more conductors of the second-sized cable. The armor stop wall includes a first end insertable into the connector passageway and has a thickness, defined between the inner and outer surfaces, which prevents the metal cladding of the second-sized cable from being inserted into the conductor receiving passageway. The armor stop wall is circumferentially discontinuous about the one or more conductors received in the conductor receiving passageway so as to allow the one or more conductors received therein to pass therethrough.

The present invention will be more readily appreciated in a reading of the "Detailed Description of the Invention" with reference to the following drawings.

DETAILED DESCRIPTION OF THE INVENTION

Figure 1:
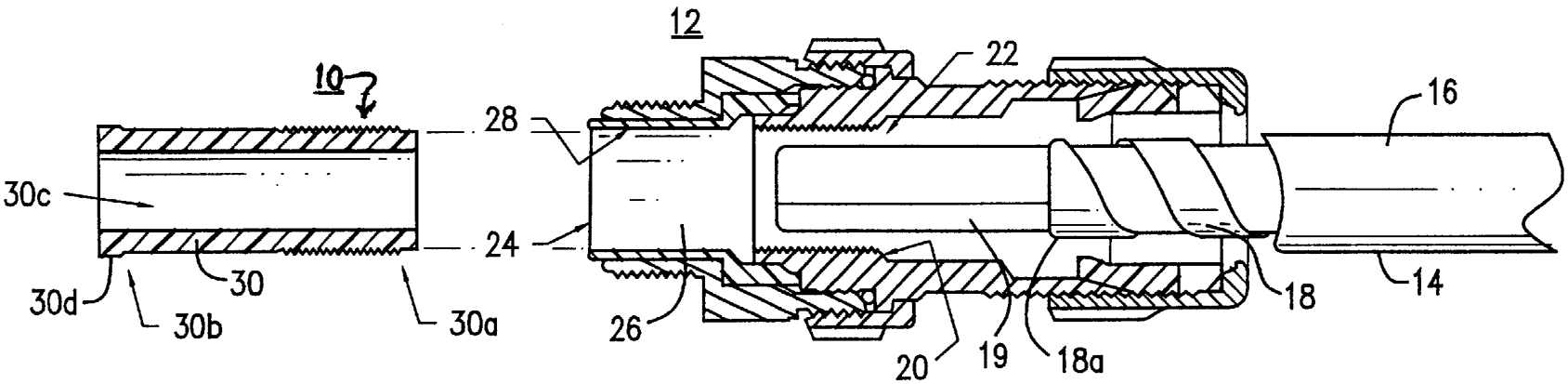
FIG. 1 shows a cross sectional view of a removable armor stop of the present invention and an associated range taking electrical connector.
Figure 2:
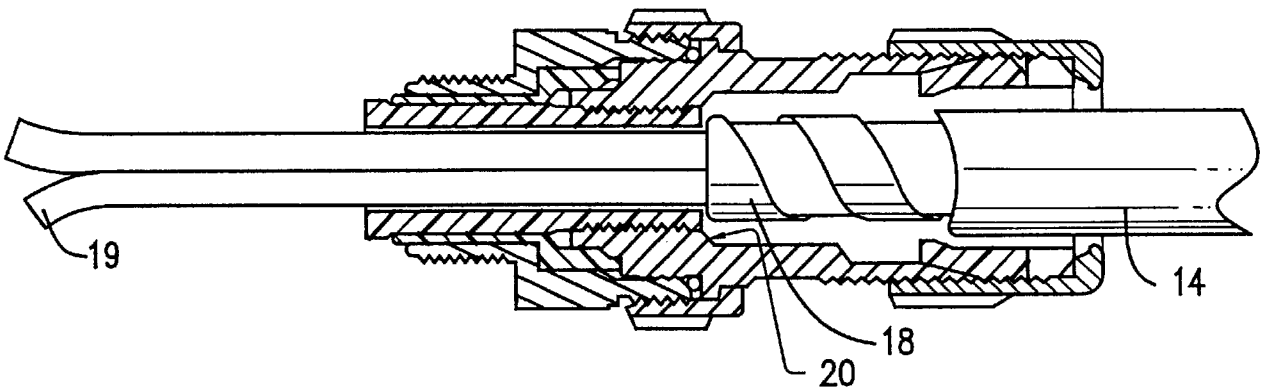
FIG. 2 shows a cross sectional view of the removable armor stop of the present invention positioned within the range taking electrical connector of FIG. 1.

Referring to FIG. 1, a removable armor stop 10 of the present invention is shown positioned adjacent to a range taking electrical connector 12. While connector 12 is shown and herein described as having similar components as provided in the commonly assigned and copending U.S. patent application Ser. No. 08/939,258, incorporated by reference herein, it is contemplated that armor stop 10 may be employed with any range taking electrical connector which may accommodate armor stop 10. Connector 12 provides for mechanical and electrical securement of an elongate metal clad cable 14.

Metal clad cable 14 includes an outer insulative jacket 16 surrounding a scroll type metallic cladding or sheath 18. Sheath 18 longitudinally encloses a number of conductors 19 extending through cable 14. These electrical conductors are contemplated as including individually insulated jackets themselves or may simply be uncoated. A portion of jacket 16 at one end of cable 14 may be stripped from its surrounding contact over sheath 18. Sheath 18 may then be cut to provide an annular edge 18*a* for abutting contact with an internal shoulder 20 of connector 12. Internal shoulder 20 defines an aperture 22 through which the plurality of electrical conductors 19 comprising the contents of cable sheath 18 may pass through so as to exit connector 12 through a cable egress opening 24. Connector 12 provides an elongate sealing cavity 26 defined by an internal gland wall 28 and an internal sealing sleeve wall 29. Sealing cavity 26 extends from an area adjacent annular edge 18*a* to cable egress opening 24.

Internal shoulder 20 may abuttingly accommodate sheaths of a range of diameters but is generally limited to sheaths having an external diameter greater than the diameter of aperture 22. Armor stop 10 is formed to be removably insertable within sealing cavity 26 by threading engagement with threads formed on internal gland wall 28.

Armor stop 10 is desirably formed of a suitable plastic material such as nylon, polypropylene, or the like. As shown particularly in FIGS. 1, 3*a–g*, and 4, armor stop 10 is an elongate generally cylindrical member having a cylindrical wall 30, opposed first and second ends 30*a* and 30*b*, and a central bore 30*c* therethrough. End 30*b* includes an annularly enlarged collar 30*d* thereat. End 30*b* of armor stop 10 is externally screw threaded for screw accommodation with internal gland wall 28 as shown in FIGS. 1 and 4. The upper surface of collar 30*d* may include a slotted location 30*e* for accommodating a tool to permit screw insertion of armor stop 10 into cable egress opening 24 of connector 12.

Figure 4:
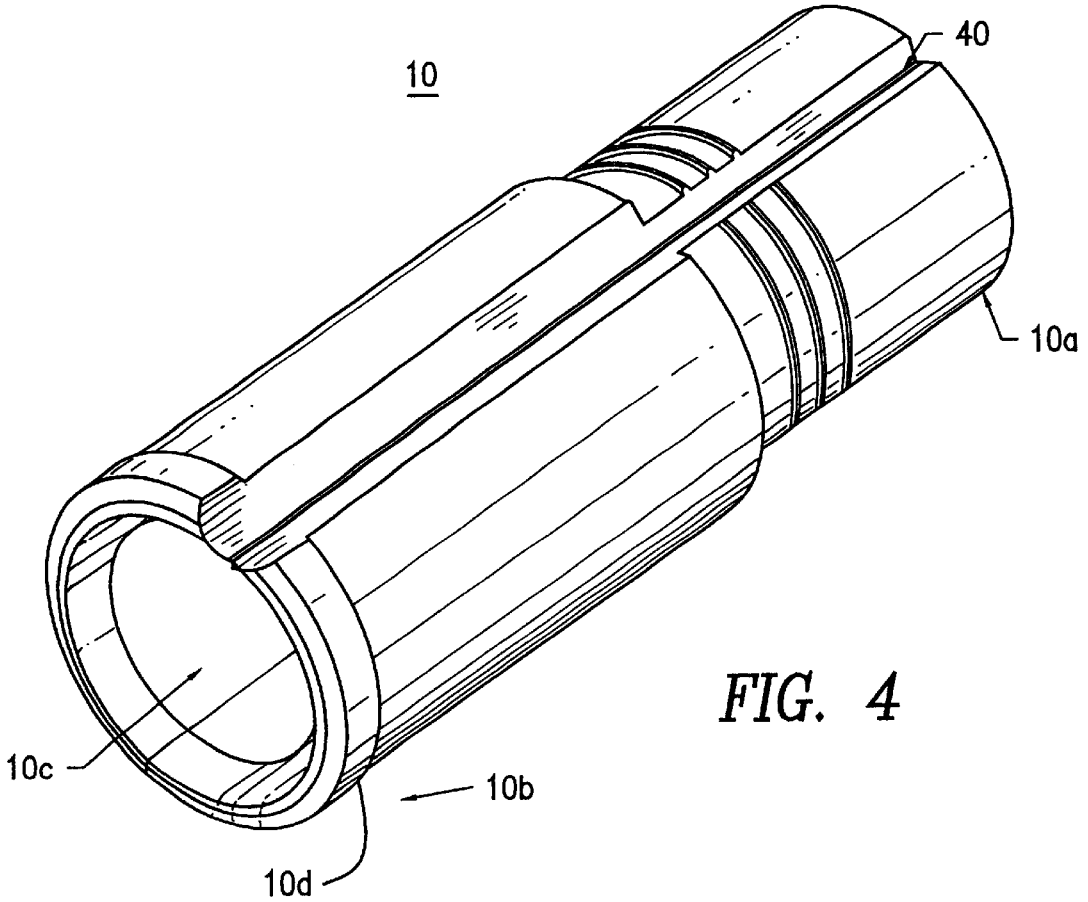
FIG. 4 shows an isometric view of a removable armor stop of the present invention in the closed configuration for insertion into a range taking electrical connector.
Figure 5:
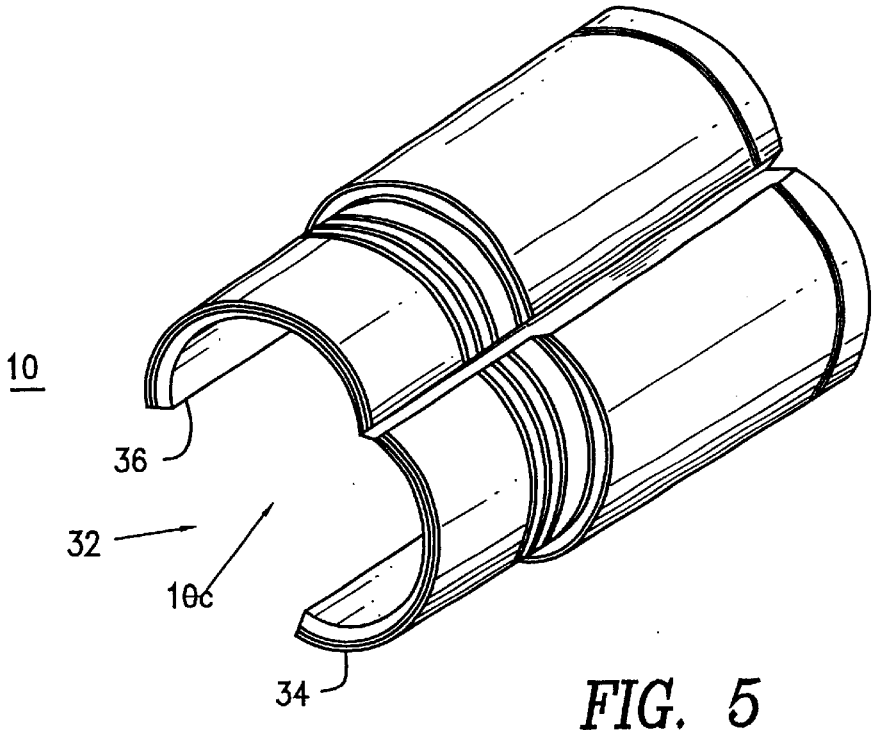
FIG. 5 shows the removable armor stop of FIG. 4 in the open configuration for receivably engaging or removably disengaging the conductors of a metal clad cable.

The present invention contemplates that armor stop 10 permits cable conductors 19 to pass through an elongate channel 32 formed by wall 30. Elongate channel 32 may be formed as a substantially straight gap between opposing wall edges 34 and 36 as shown in FIGS. 3*a–g* and 5. Edges 34 and 36 are desirably formed to deflect if so required to allow conductors 19 to pass through channel 32 into or out of central bore 30*c*. As seen in FIG. 5, wall 30 may include at least one elongate hinge 40 formed by the closed end of a notch opening towards major surface 31*a*. Opposing wall edges 34 and 36 are thereby formed on opposing sides, so as to more easily deflect about, of the at least one elongate hinge 40. Hinge 40 allows an installer to readily reconfigure armor stop 10 between an open position, shown in FIG. 5, so as to allow conductors 19 to pass through channel 32, and a closed position, shown in FIG. 4, so as to allow armor stop 10 to achieve a cylindrical configuration and to receive conductors 19 within central bore 30*c*. Furthermore, in the closed position, armor stop may be removably inserted in the sealing cavity 26 of connector 12. The readiness of the present invention to be opened or closed about conductors 19 of cable 14 provides for easier assembly and potting of a range taking electrical connector.

Figure 3A:
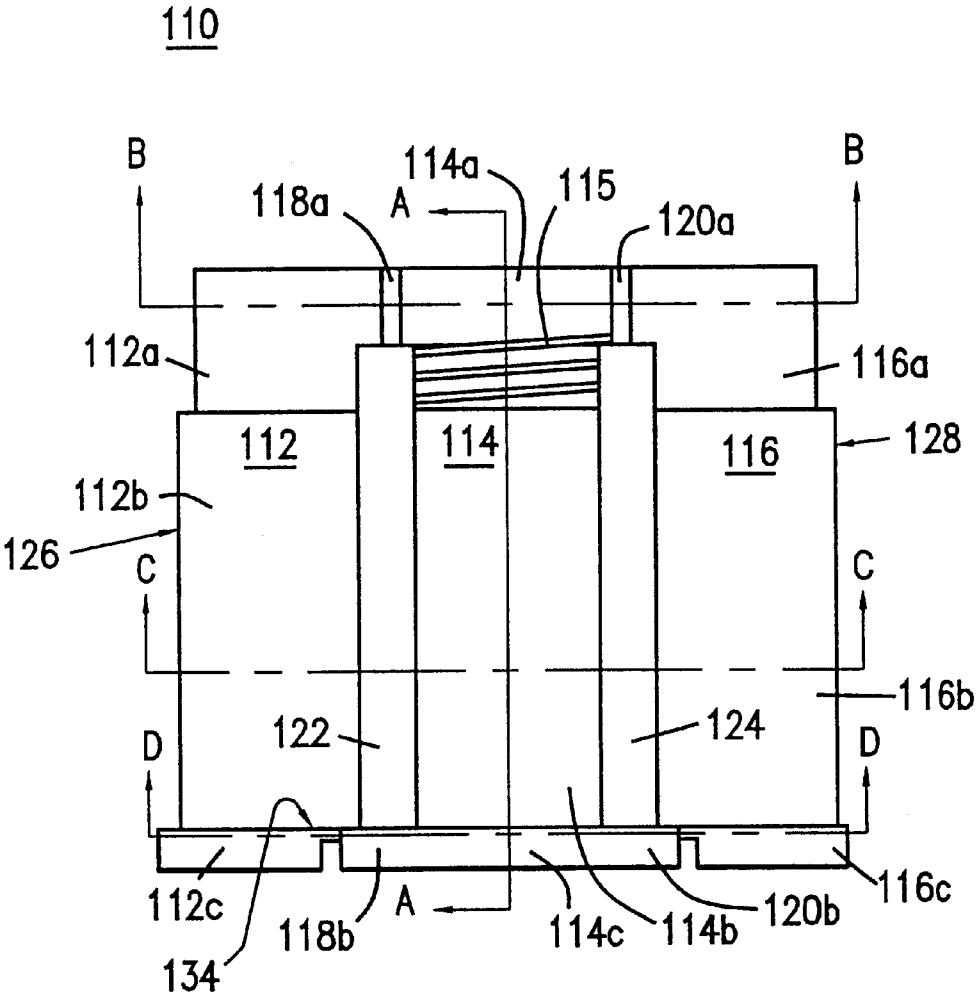
FIG. 3*a* shows a side elevational view of a removable armor stop of the present invention in an open, uninserted configuration.
Figure 3B:
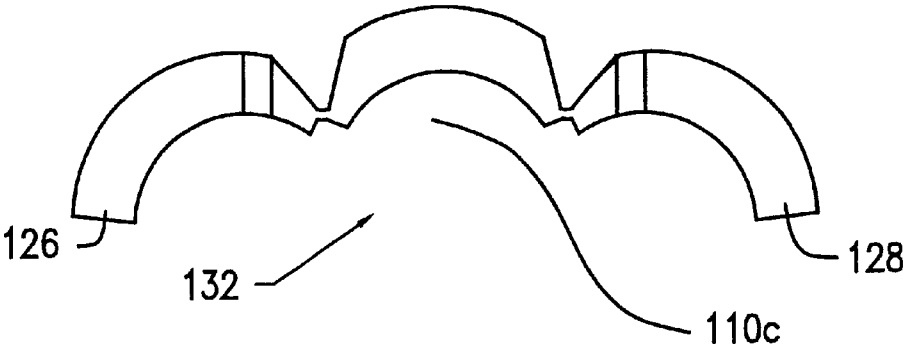
FIG. 3*b* shows a top elevational view of a the removable armor stop of FIG. 3*a*.
Figure 3C:
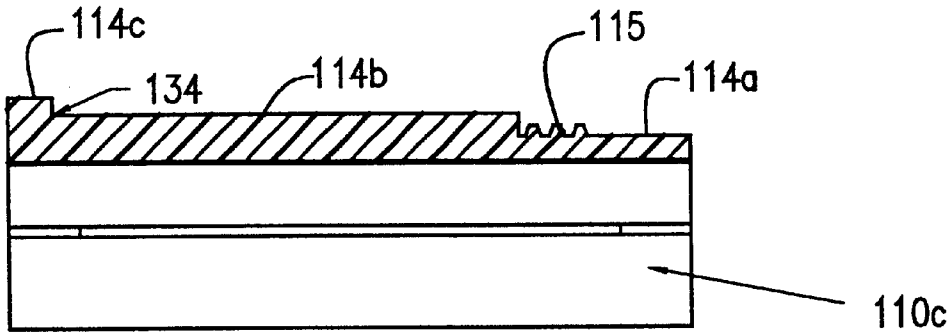
FIG. 3*c* shows a cross-sectional view of the removable armor stop of FIG. 3*a* taken through the line A—A.
Figure 3D:
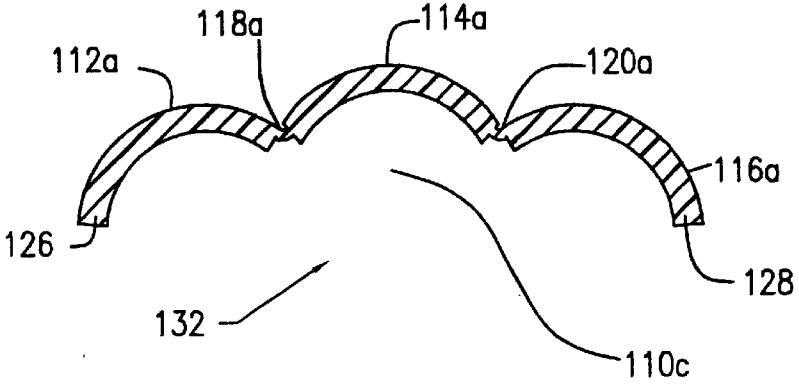
FIG. 3*d* shows a cross-sectional view of the removable armor stop of FIG. 3*a* taken through the line B—B.
Figure 3E:
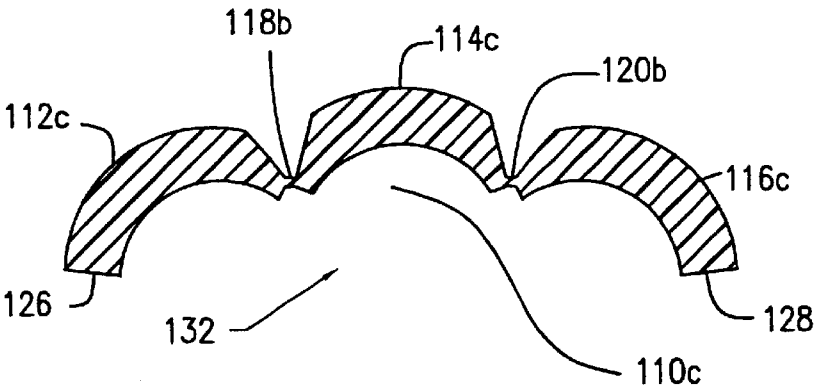
FIG. 3*e* shows a cross-sectional view of the removable armor stop of FIG. 3*a* taken through the line D—D.
Figure 3F:
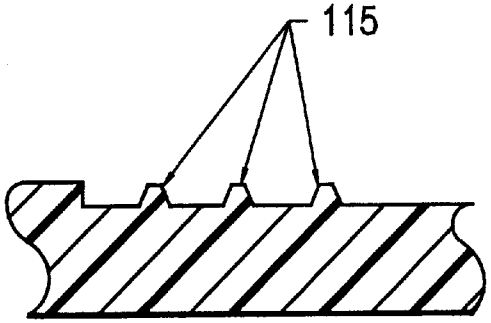
FIG. 3*f* shows a cross-sectional partial view of the removable armor stop of FIG. 3*a*.
Figure 3G:
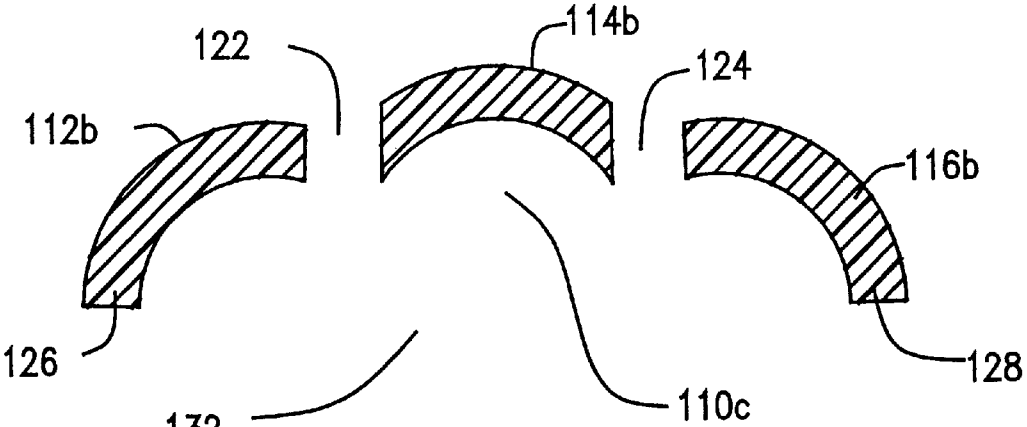
FIG. 3*g* shows a cross-sectional view of the removable armor stop of FIG. 3*a* taken through the line C—C.

FIGS. 3*a–g* provides details of another armor stop 110 of the present invention. FIGS. 3*a* and 3*b* show armor stop 110 in a fully open configuration in which a central bore 110*c* is accessible to the conductors 19 of cable 14. Armor stop 110 includes three elongate arcuate walls 112, 114, and 116 which define central bore 110*c*. Armor stop 110 desirably provides three longitudinally successive and distinct exterior diameters when in the closed configuration. The first distinct exterior diameter is provided by wall portions 112*a*, I 14*a*, and 116*a*. Wall portion 114*a* may further include one or more elongate threads 115 so as to provide threading engagement between armor stop 110 and internal gland wall 28 of connector 12. The second distinct exterior diameter is provided by wall portions 112*b*, 114*b*, and 116*b*. The third distinct exterior diameter is provided by wall portions 112*c*, 114*c*, and 116*c* which define an annularly large collar providing an annular stop surface 134 which limits the insertion of armor stop 110 into connector 12 so that cable 14 may be properly positioned therein.

Wall 114 connects to wall 112 across a first proximal hinge 118*a* and a first distal hinge 120*a*. Wall 114 similarly connects to wall 116 across a second proximal hinge 118*b* and a second distal hinge 120*b*. Armor stop 110 defines a first elongate window 122 between first hinges 118*a* and 120*a* and a second elongate window 124 between second hinges 118*b* and 120*b*. Wall 112 includes an elongate edge 126 and wall 116 includes an opposed elongate edge 128. Edges 126 and 128 define an elongate channel 132 therebetween through which conductors 19 of cable 14 are received and delivered from central bore 110*c*. The span of channel 132 between edges 126 and 128 changes as armor stop 110 is reconfigured between an closed configuration to an open configuration.

Operation of armor stop 10 simply entails inserting the armor stop into sealing chamber 26 so that edge 31 is substantially co-planar with internal shoulder 20 so as to increase the range of sizes of cables connector 12 may accommodate. At least a portion of sheath edge 18*a* abuts armor stop edge 31 so as to properly position cable 14 within connector 12. Once the connector components are fully assembled, armor stop 10 may be backed out of sealing connector 12 by rotating collar 30*d* about central bore 30*c*. When the free ends of the conductors 19 are terminated in electrical connection, armor stop 10 may be manually removed from about conductors 19 extending by passing conductors 19 through channel 32. conductors 19 of cable 14 may then be potted within sealing cavity 26 using a flowable sealing compound which may fill the void remaining between conductors 19 and internal gland wall 28.

It is also contemplated that channel 32 may take other forms as well. For example, channel 32 may be formed between overlapping deflectable edges 34 and 36 (not shown). Similarly, channel 32 may be formed as a helical channel formed between opposed deflectable edges 34 and 36 (not shown) and may further include a frangible connecting seam (not shown) which may be opened by transversely pulling one end of edge 34 with respect to the opposed end of edge 36.

Thus the present invention provides an armor stop with a generally cylindrical configuration where an opening or passage may be established in the wall thereof to permit removal of the stop from its position about an extending electrical conductor without requiring cutting or the use of tools.

Various changes to the foregoing described and shown structures would now be evident to those skilled in the art. Accordingly, the particularly disclosed scope of the invention is set forth in the following claims.

What is claimed is:

1. In a range taking electrical connector assembly for terminating a first-sized multiconductor cable having a metal cladding of a diameter within a first range of diameters, said connector assembly including a connector housing defining a cable ingress opening, a conductor egress opening, and an elongate cable passageway extending therebetween, said connector further including an internal annular shoulder extending into said cable passageway and providing for abutting engagement with the metal cladding of a first-sized cable; a removable stop insertable into the conductor egress opening for providing abutting engagement with metal cladding of a second-sized multiconductor cable having a diameter smaller than the first-sized cable, said removable stop comprising:

an elongate arcuate stop wall having opposed inner and outer surfaces, said inner surface defining a conductor receiving passageway for receiving one or more conductors of the second-sized cable;

said stop wall including a first end insertable into said connector passageway and having a thickness defined between said inner and outer surfaces which prevents the metal cladding of the second-sized cable from being inserted into said conductor receiving passageway; and said stop wall being circumferentially discontinuous about the one or more conductors received in said conductor receiving passageway so as to allow the one or more conductors received therein to pass through said circumferential discontinuity.

2. The connector assembly of claim 1, wherein said outer surface of said stop wall engages an interior surface of the range taking electrical connector about cable passageway.

3. The connector assembly of claim 1, wherein said outer surface of said stop wall is screw threaded.

4. The connector assembly of claim 1, further including an annularly-enlarged collar to limit insertion of said first end of said stop into said terminating passageway.

5. The connector assembly of claim 1, wherein said stop wall further includes at least one notch having a closed end defining a flexible hinge about which said stop wall deflects between an open configuration allowing the one or more conductors received in said conductor receiving passageway to be removed through said stop wall and a closed configuration allowing said stop to be inserted into the range taking electrical connector.

6. The connector assembly of claim 5, wherein said stop wall defines at least one elongate longitudinal window bounded by flexible hinges about which said stop wall deflects between an open configuration allowing said one or more conductors received in said conductor receiving passageway to be removed through said stop wall and a closed configuration allowing said stop to be inserted into the range taking electrical connector.

7. The connector assembly of claim 1, wherein said stop wall further includes opposed longitudinal edges extending in overlapping registry with each other so as to be deflectable to allow said cable in said cable passageway to pass therethrough.

8. The connector assembly of claim 1, wherein said stop wall defines an elongate gap between opposed longitudinal edges thereof through which the one or more conductors in said conductor receiving passageway may pass.

9. The connector assembly of claim 8, wherein said stop wall defines an elongate helical gap between opposed longitudinal edges thereof.

10. The connector assembly of claim 1, wherein said stop wall includes a first end positionable adjacent to the interior shoulder of the electrical connector for abutting engagement.

* * * * *

UNITED STATES PATENT AND TRADEMARK OFFICE

CERTIFICATE OF CORRECTION

PATENT NO. : 6,299,485 B1
DATED : October 9, 2001
INVENTOR(S) : Marik, G.

It is certified that error appears in the above-identified patent and that said Letters Patent is hereby corrected as shown below:

Title page,
Item [57], ABSTRACT,
Line 15, incorrectly reads "...wall is circumferentially an discontinuous..". should read -- wall is circumferentially a discontinuous… --.

Column 1,
Line 59, reads "...provided in the commonly U.S. Pat. No. 5,951,327…". should read -- ...provided in the commonly assigned U.S. Pat. No. 5,951,329… --.

Column 5,
Line 38, reads "...portions 112a, I 14a,". should read -- ...portions 112a, 114a, --.

Signed and Sealed this

Twenty-seventh Day of August, 2002

*Attest:*

*Attesting Officer*

JAMES E. ROGAN
*Director of the United States Patent and Trademark Office*